United States Patent [19]

Renner et al.

[11] Patent Number: 4,855,222

[45] Date of Patent: Aug. 8, 1989

[54] COLOR PHOTOGRAPHIC RECORDING MATERIAL

[75] Inventors: Günter Renner, Bergisch Gladbach; Erich Wolff, Solingen; Heinz Wiesen, Euskirchen; Werner Liebe, Leverkusen, all of Fed. Rep. of Germany

[73] Assignee: Agfa-Gevaert Aktiengesellschaft, Fed. Rep. of Germany

[21] Appl. No.: 273,955

[22] Filed: Nov. 18, 1988

[30] Foreign Application Priority Data

Dec. 4, 1987 [DE] Fed. Rep. of Germany ..... 3741088

[51] Int. Cl.[4] ..... G03C 7/36

[52] U.S. Cl. ..... 430/557; 430/389

[58] Field of Search ..... 430/557, 389, 558 R

[56] References Cited

U.S. PATENT DOCUMENTS

| | | | |
|---|---|---|---|
| 4,049,458 | 9/1977 | Boie et al. | 430/557 |
| 4,529,691 | 7/1985 | Renner et al. | 430/557 |
| 4,617,256 | 10/1986 | Kunitz et al. | 430/557 |

OTHER PUBLICATIONS

Chem Abstracts 98:44120s "Photographic . . . Couplers", abstract of DE 3,107,173, Wolff et al, 1983.

*Primary Examiner*—Richard L. Schilling

*Attorney, Agent, or Firm*—Connolly & Hutz

[57] ABSTRACT

Dye images of high color yield and high gradation are obtained with a color photographic recording material containing 2-equivalent yellow couplers corresponding to formula I, particularly in modern rapid processing methods or in developers free from benzyl alcohol.

I $R^1$, $R^2$ (same or different) represent hydrogen, alkyl or halogen;

$R^3$ represents alkoxyalkyl or an alkyl radical substituted by a heterocyclic group containing at least one oxygen atom;

$R^4$ represents alkyl or aryl;

$R^5$ represents halogen or alkoxy;

$R^6$ represents hydrogen, alkoxy, amino, acylamino or carbamoyl;

represents alkoxy, acylamino, carbalkoxy, carbamoyl or sulfamoyl.

1 Claim, 1 Drawing Sheet

COLOR PHOTOGRAPHIC RECORDING MATERIAL

Figure 1:
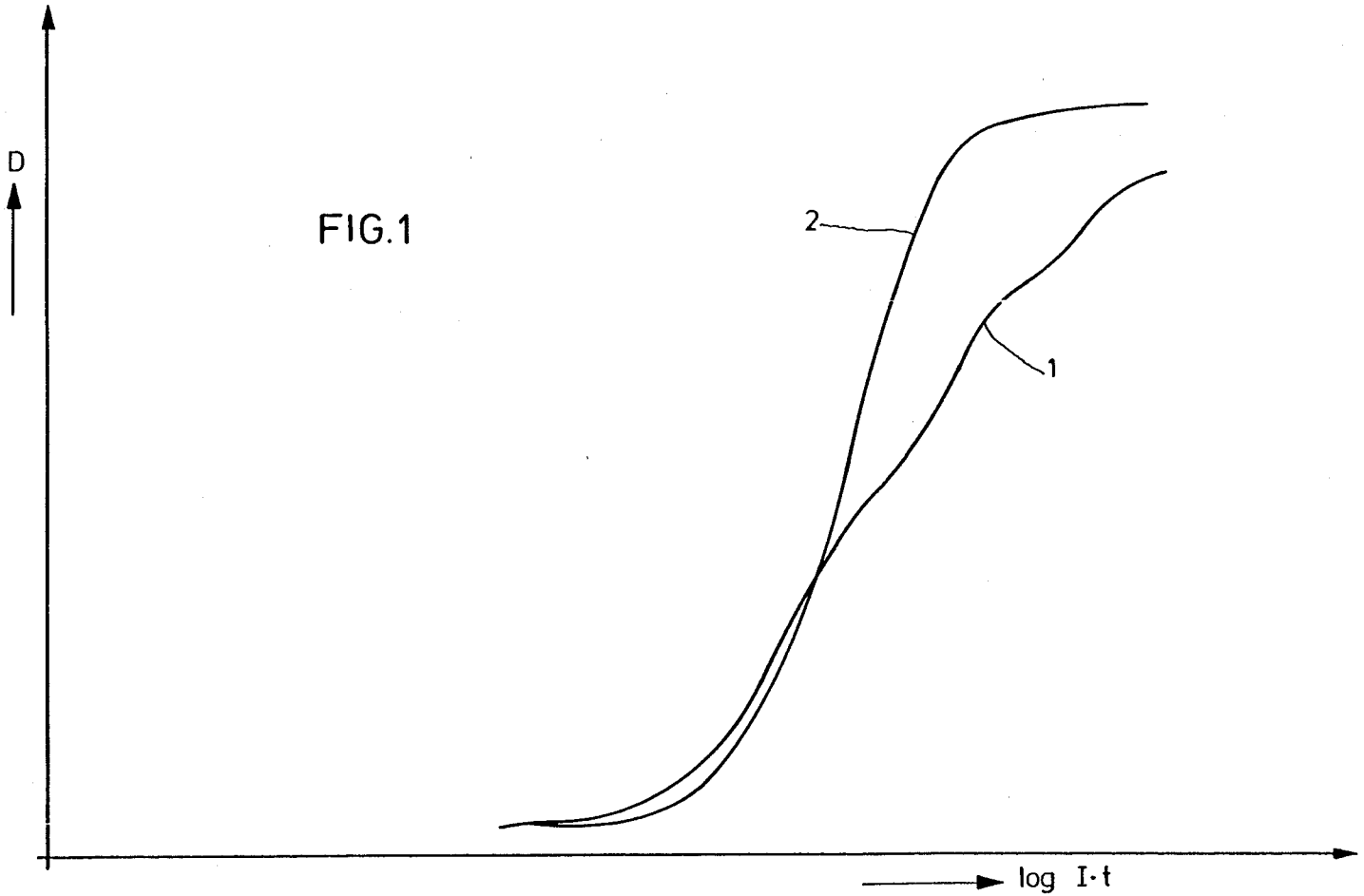

This invention relates to a color photographic recording material containing a new 2-equivalent yellow coupler.

A photosensitive photographic recording material is generally used in subtractive three-color photography, containing red-sensitive, green-sensitive and blue-sensitive silver halide emulsion layers in which a cyan, a magenta and a yellow dye image, respectively, are formed during color development and where suitable color couplers are used.

In practice, the color couplers and the dyes obtained from them by chromogenic development have to satisfy a number of requirements. Thus, the rate at which the color couplers couple with the oxidation product of the color developer should be as high as possible, in addition to which it should be possible to obtain as a maximal color density as possible. The color couplers and the dyes obtained from them have to show adequate stability to light, elevated temperature and moisture. This applies both to fresh material and also to processed material. For example, the residual coupler still present in the white image areas must not yellow. In addition, the dyes are required to show adequate stability to gaseous reducing or oxidizing agents. In addition, they have to be anchored in non-diffusing form in the image layer and should separate as an extremely fine grain during chromogenic development. Finally, the dyes formed from the color couplers during chromogenic development must show a favorable absorption curve with a maximum, which corresponds to the color of the particular component image required, and negligible secondary absorptions.

The requirements stated above apply in particular to yellow couplers because yellow couplers are often arranged in the uppermost dye-producing layer in color photographic recording materials and, hence, not only are particularly exposed to environmental influences, but also influence the underlying layers, particularly in regard to sharpness. Accordingly, advantages are afforded by any measures by which the burden on the layers, particularly the layer containing a yellow coupler, can be reduced. A very significant contribution in this regard is made by the use of 2-equivalent yellow couplers because couplers of this type are known to require a smaller quantity of silver halide to produce a certain quantity of dye.

Numerous proposals have already been put forward for 2 -equivalent yellow couplers. 2-Equivalent yellow couplers, to the coupling position of which a releasable imidazole group is attached, have proved to be particularly advantageous in regard to various properties, including in particular dispersibility, fogging behavior and stability of the final image (DE-Pat. No.-A-23 29 587). 2-Equivalent yellow couplers containing a releasable imidazole-2-carboxylic acid ester group are also known (DE-Pat. No.-A-31 07 173).

However, the known 2-equivalent yellow couplers are still not satisfactory in every respect on account of various disadvantages. For example, there is still a need further to increase reactivity in order in this way to improve the dye yield. In addition, it has been found that, although many of the known 2-equivalent yellow couplers give satisfactory results providing development lasts long enough, inadequate dye production is obtained in modern rapid processing methods or with developers free from benzyl alcohol.

The object of the present invention is to provide yellow couplers for a color photographic recording material which dissolve readily in various oil formers and which, during chromogenic development, produce yellow image dyes having the desired spectral and stability properties and a high dye yield. In addition, the yellow couplers are intended to provide sufficiently high dye yields and steep color gradations even in developers of low activity, for example in developers free from benzyl alcohol, or in rapid processing methods with a development time of shorter than 3 minutes. This object is achieved by the color photographic recording material according to the invention.

The present invention relates to a color photographic recording material comprising at least one photosensitive silver halide emulsion layer and, associated therewith, a 2-equivalent yellow coupler, to the coupling position of which an imidazole-2-carboxylic acid ester group is attached through a ring nitrogen atom, characterized in that the 2-equivalent yellow coupler corresponds to the following formula

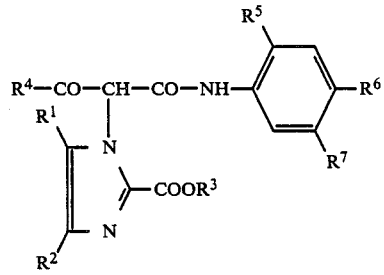

in which $R^1$, $R^2$ (same or different) represent hydrogen, alkyl or halogen;

$R^3$ represents alkoxyalkyl or an alkyl radical substituted by a heterocyclic group containing at least one oxygen atom;

$R^4$ represents alkyl or aryl;

$R^5$ represents halogen or alkoxy;

$R^6$ represents hydrogen, halogen, alkoxy, amino, acylamino or carbamoyl;

$R^7$ represents alkoxy, acylamino, carbalkoxy, carbamoyl or sulfamoyl.

An alkyl group represented by $R^1$, $R^2$ contains, for example, up to 4 carbon atoms. A halogen atom represented by $R^1$, $R^2$ is, for example, Cl or Br.

An alkoxyalkyl group represented by $R^3$ is linear or branched and preferably contains up to 20 carbon atoms. The groups in question are preferably alkyl groups containing up to 4 carbon atoms which are substituted by at least one alkoxy group. The alkoxy group mentioned includes substituted alkoxy groups, more especially alkoxyalkoxy groups or the benzyloxy group. The alkoxyalkyl groups represented by $R^3$ may also be interpreted as linear or branched alkyl groups containing up to 20 carbon atoms which are interrupted by one or more oxygen atoms.

As already mentioned, $R^3$ may also be an alkyl group substituted by a heterocyclic group containing at least one oxygen atom. A heterocyclic group of the type in question may be, for example, a saturated 4-, 5- or 6-membered ring, of which the last two in particular may contain one or two oxygen atoms. A heterocyclic ring of this type may also be substituted by alkyl groups, may contain another heteroatom different from oxygen, for example N or S, and/or may be fused to another ring, for example a benzene ring.

A preferred feature shared by the groups represented by $R^3$ is that at least one ether oxygen atom is separated from the ester group on the imidazole ring by no more than four carbon atoms.

Examples of groups $R^3$ according to the invention are given in the following:

$-CH_2-CH_2-O-CH_3$ $-CH_2-CH_2O-CH_2-CH_3$ $-CH_2-CH_2-O-(CH_2)_3-CH_3$ $-CH_2-CH_2-O-CH_2-CH_2-O-C_2H_5$ $-CH_2-CH_2-O-CH_2-CH_2-O-C_4H_9$ $-CH_2-CH_2-O-CH_2-CH_2-O-CH_2-CH_2-O-CH_3$

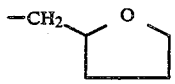

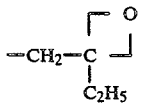

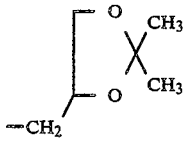

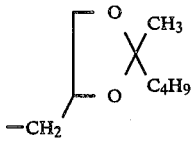

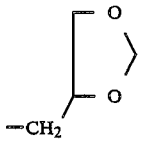

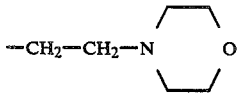

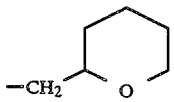

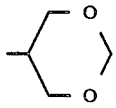

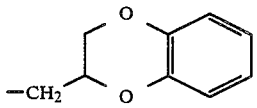

-continued

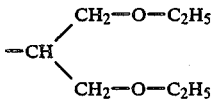

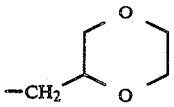

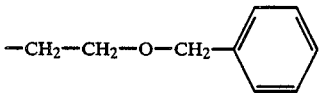

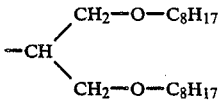

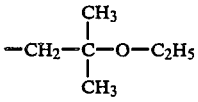

The coupler residue corresponding to the formula

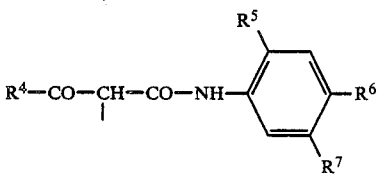

is the residue of a typical yellow coupler, for example of the benzoyl acetanilide type or of the pivaloyl acetanilide type. An alkyl radical represented by $R^4$ comprises up to 24 carbon atoms and preferably contains a tertiary carbon atom attached directly to the carbonyl group. One preferred example of this is tert.-butyl. An aryl radical represented by $R^4$ is, preferably, a phenyl group substituted by alkyl, acylamino or alkoxy.

In the acylamino group represented by $R^6$ or $R^7$ which is present as a substituent at the phenyl group mentioned, the acyl radical is derived from aliphatic or aromatic carboxylic or sulfonic acids or from carbonic acid semiesters or from carbamic or sulfamic acids, in which one or two hydrogen atoms may be substituted at the nitrogen atom by alkyl, aralkyl or aryl.

An alkoxy group represented by $R^5$, $R^6$ or $R^7$, which is present as a substituent at a phenyl group represented by $R^4$, may contain from 1 to 18 carbon atoms. $R^5$ may be, for example, chlorine, methoxy or tetradecyloxy.

$R^6$ may be, for example, hydrogen, chlorine, methoxy or n-octyloxy.

$R^7$ may be, for example, methoxy, 4-(2,4-di-tert.-amylphenoxy)-butyramido, hexadecylsulfonylamino, hexadecyloxycarbonyl, N-hexadecylcarbamoyl, N-methylsulfamoyl, N-hexadecylsulfamoyl, hexadecanoylamido.

By a suitable choice of the substituents $R^4$, $R^5$, $R^6$ or $R^7$, the 2-equivalent yellow couplers according to the invention are provided with at least one radical which makes them resistant to diffusion, for example with a linear or branched $C_{10}$–$C_{18}$ alkyl radical or with alkyl-substituted phenoxy radicals attached either directly or indirectly, for example through —O—, —S—, —CONH—, —NHCO—, —$SO_2NH$—, —$NHSO_2$— or other intermediate members, to the optionally aromatic radical $R^4$ or to the aniline group. Where solubility in alkali is required, at least one of the substituents mentioned may contain alkali-solubilizing groups, preferably sulfo groups. Examples of suitable yellow couplers according to the invention are shown in the following:

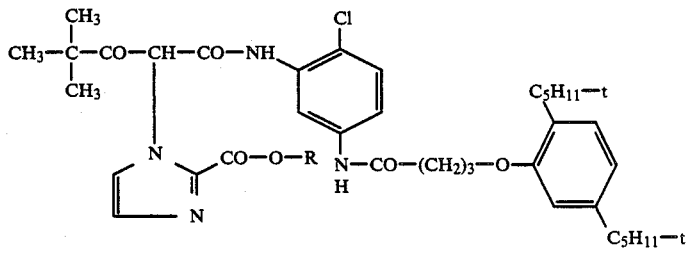

| Y— | R |
|---|---|
| 1 | $-CH_2-CH_2-OCH_3$ |
| 2 | $-CH_2-CH_2-O-CH_2-CH_3$ |
| 3 | 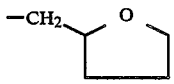 |
| 4 | 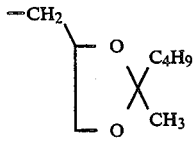 |
| 5 | 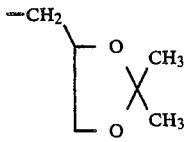 |
| 6 | 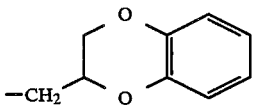 |
| 7 | 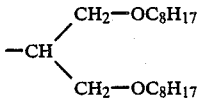 |
| 8 | $-CH_2-CH_2-O-CH_2-CH_2-O-C_4H_9$ |

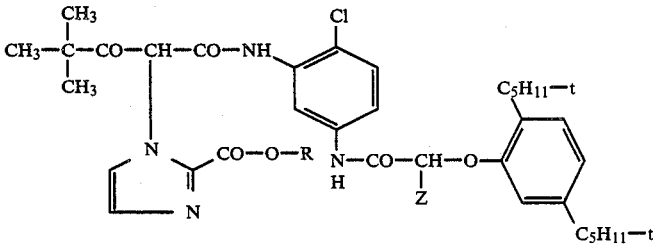

| Y— | R | Z |
|---|---|---|
| 9 | $-CH_2-CH_2-O-CH_2-CH_3$ | $-C_4H_9$ |
| 10 | $-CH_2-CH_2-O-CH(CH_3)_2$ | $-C_4H_9$ |

-continued
| | | |
|---|---|---|
| 11 | 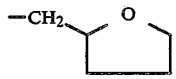 | $-C_4H_9$ |
| 12 | $-CH_2-CH_2-OC_2H_5$ | $-C_2H_5$ |
| 13 | 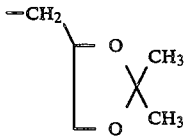 | $-C_2H_5$ |
| 14 | 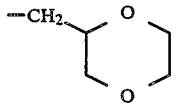 | $-C_2H_5$ |
| 15 | $-CH_2-CH_2-OC_2H_5$ | H |
| 16 | 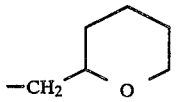 | H |
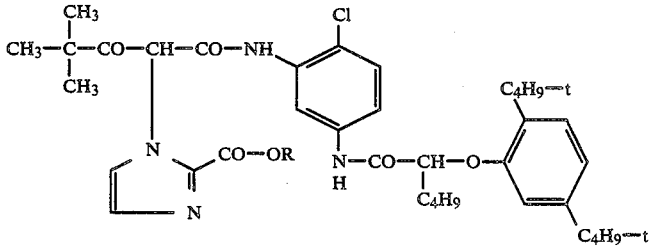
| Y— | R |
|---|---|
| 17 | $-CH_2-CH_2-OCH_3$ |
| 18 | 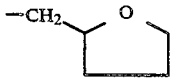 |
| 19 | 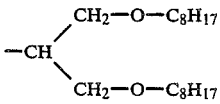 |
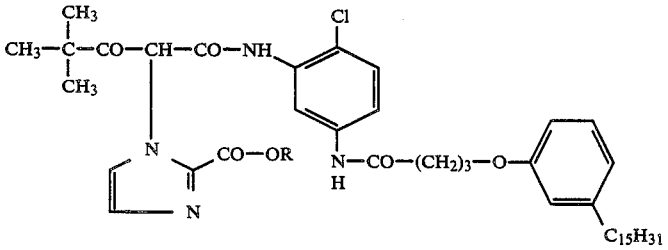
| Y— | R |
|---|---|
| 20 | $-CH_2-CH_2-OC_2H_5$ |
| 21 | 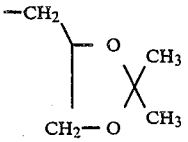 |

-continued
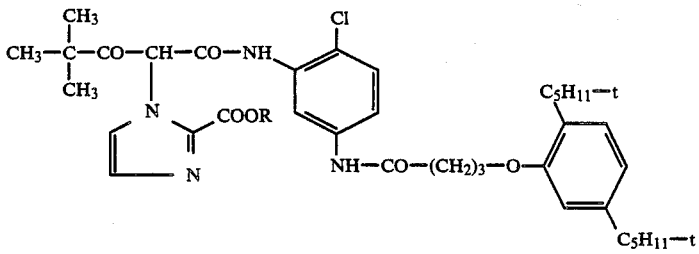
| Y— | R |
|---|---|
| 22 | $-CH_2-CH_2-OCH_3$ |
| 23 | $-CH_2-CH_2-OCH_2-CH_2-OC_4H_9$ |
| 24 | 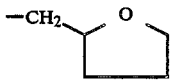 |
| 25 | 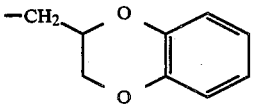 |
| 26 | 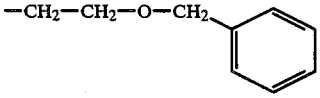 |
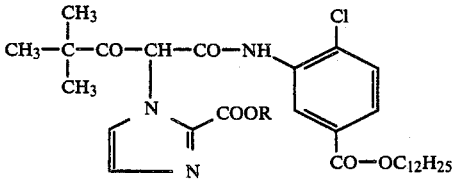
| Y— | R |
|---|---|
| 27 | $-CH_2-CH_2-OCH_3$ |
| 28 | $-CH_2-CH_2-O-CH_2-CH_2-O-C_2H_5$ |
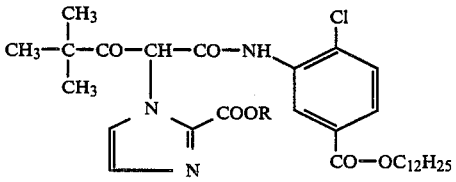
| Y— | R |
|---|---|
| 29 | 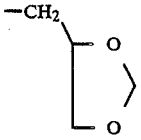 |
| 30 | 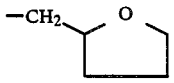 |
| 31 | 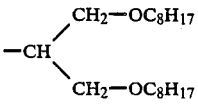 |

-continued
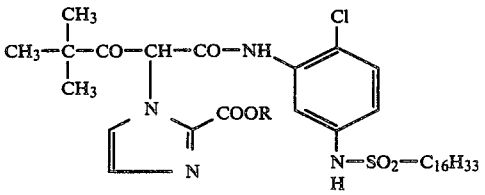
| Y— | R |
|---|---|
| 32 | $-CH_2-CH_2-OCH_3$ |
| 33 | 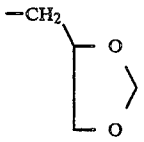 |
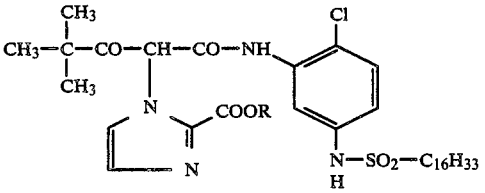
| Y— | R |
|---|---|
| 34 | 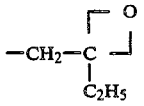 |
| 35 | 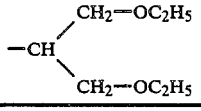 |
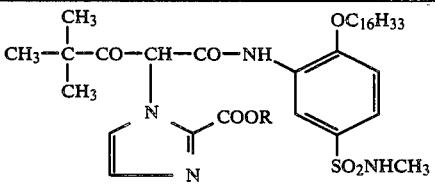
| Y— | R |
|---|---|
| 36 | $-CH_2-CH_2-OCH_3$ |
| 37 | $-CH_2-CH_2-OC_2H_5$ |
| 38 | 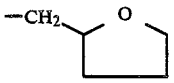 |
| 39 | 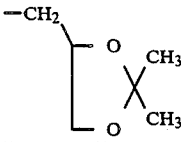 |
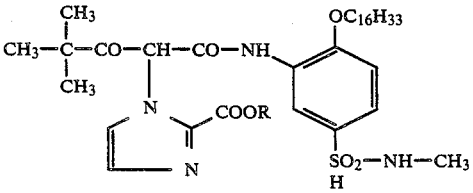
| Y— | R |
|---|---|

-continued
| | |
|---|---|
| 40 | 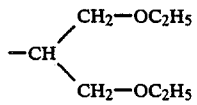 |
| 41 | 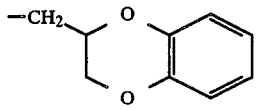 |
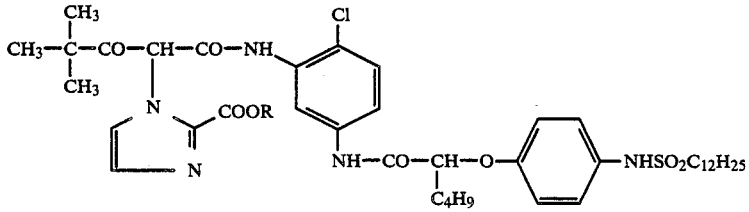
| | R |
|---|---|
| 45 | $-CH_2-CH_2-OC_2H_5$ |
| 46 | $-CH_2-CH_2-O-CH_2-CH_2-OC_2H_5$ |
| 47 | 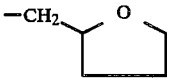 |
| 48 | 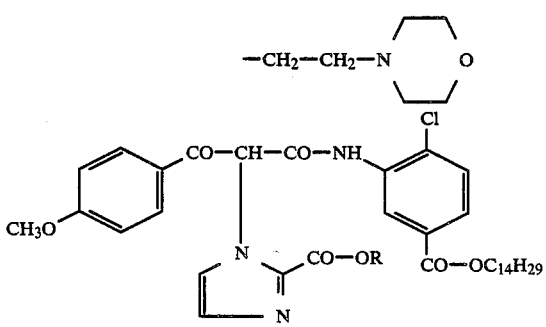 |
| Y— | R |
|---|---|
| 49 | $-CH_2-CH_2-OCH_3$ |
| 50 | $-CH_2-CH_2-O-CH_2-CH_2-OC_2H_5$ |
| 51 | 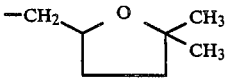 |
| 52 | 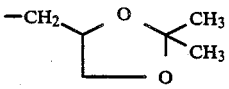 |
| 53 | 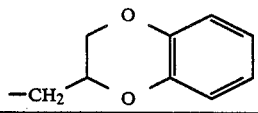 |
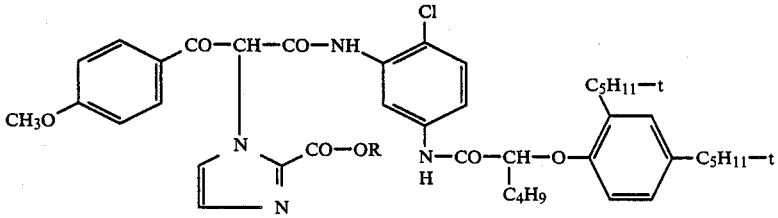
| Y— | R |
|---|---|

-continued
| | |
|---|---|
| 54 | $-CH_2-CH_2-OC_2H_5$ |
| 55 | 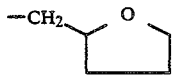 |
| 56 | 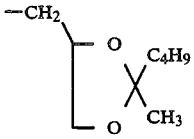 |
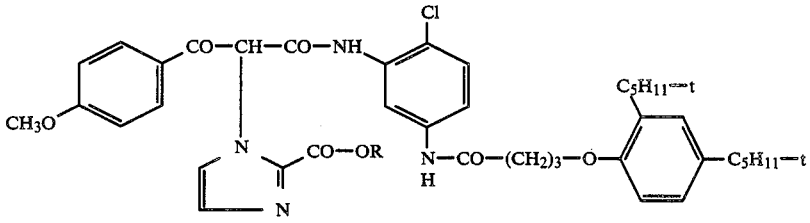
| Y— | R |
|---|---|
| 57 | $-CH_2-CH_2-OC_2H_5$ |
| 58 | $-CH_2-CH_2-O-CH_2-CH_2-OC_4H_9$ |
| 59 | 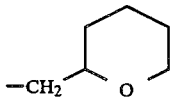 |
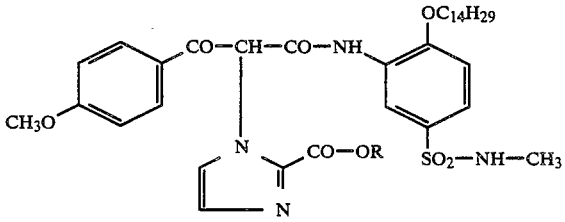
| Y— | R |
|---|---|
| 60 | $-CH_2-CH_2-O-C_2H_5$ |
| 61 | 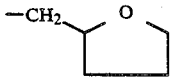 |
| 62 | 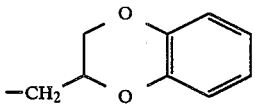 |
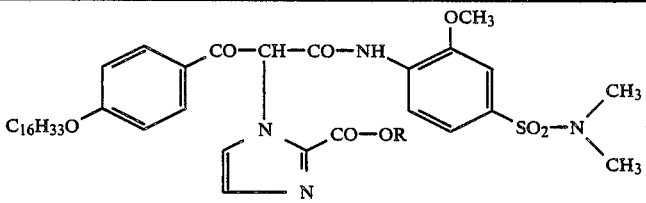
| Y— | R |
|---|---|
| 63 | $-CH_2-CH_2-OCH_3$ |
| 64 | $-CH_2-CH_2-O-CH_2-CH_2-O-C_4H_9$ |
| 65 | $-CH_2-CH_2-O-CH_2-CH_2-O-CH_2-CH_2-OCH_3$ |
| 66 | 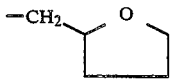 |

-continued
| | |
|---|---|
| 67 | 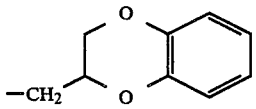 |
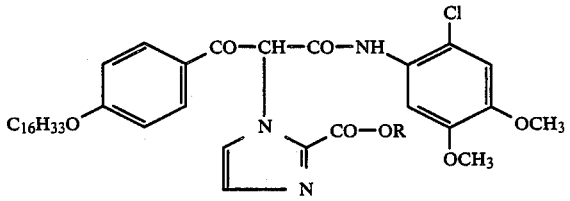
| Y— | R |
|---|---|
| 68 | $-CH_2-CH_2-O-CH_2-CH_2-O-C_2H_5$ |
| 69 | 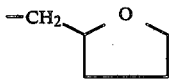 |
| 70 | 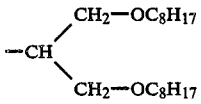 |
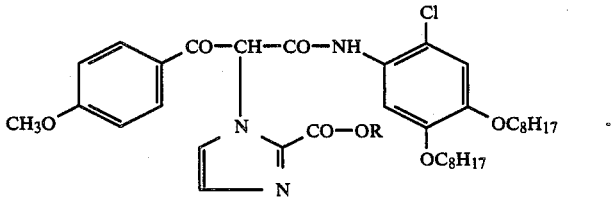
| Y— | R |
|---|---|
| 71 | $-CH_2-CH_2-OCH_3$ |
| 72 | 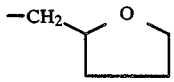 |
| 73 | 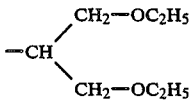 |
| 74 | 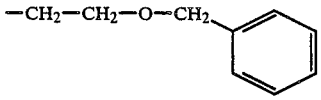 |
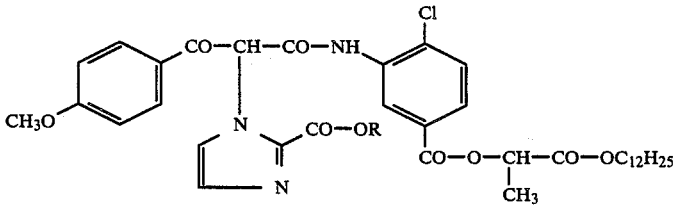
| Y— | R |
|---|---|
| 75 | $-CH_2-CH_2-OC_2H_5$ |
| 76 | 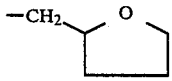 |

-continued

| | |
|---|---|
| 77 | 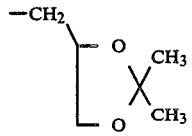 |

The 2-equivalent yellow couplers according to the invention may be prepared from the corresponding 4-equivalent yellow couplers by initially converting the 4-equivalent yellow couplers in a known manner into the corresponding 2-equivalent yellow couplers substituted by halogen (bromine, chlorine) in the coupling position and reacting the 2-equivalent yellow couplers thus formed with one of the desired imidazole carboxylic acid ester leaving groups, again in a known manner. The methods used for this purpose are sufficiently well known (DE-Pat. No.-A-23 29 587) and need not be described in detail here. Alternatively, the one-step reaction according to DE-Pat. No.-A-25 45 756 is also possible.

The imidazole-2-carboxylic acid esters used as leaving groups may readily be obtained by reaction of a dimeric ketene corresponding to the following formula

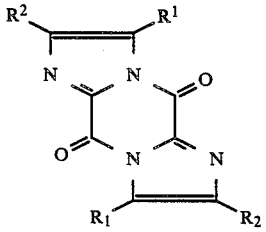

with alcohols corresponding to the formula $H—O—R^3$ optionally in the presence of a diluent and optionally in the presence of a catalyst at temperatures of from −50° to +200° C.

The dimeric ketene itself may be obtained by reaction of imidazole-2-carboxylic acid with thionyl chloride. The preparation of the dimeric ketene and its reaction to various esters is described in DE-Pat. No.-A-23 51 203.

Preparation of the ester corresponding to the formula:

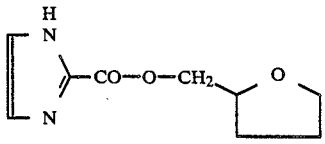

(intermediate product for the preparation of, for example, yellow coupler Y-3 according to the invention):

250 g 2-hydroxymethyl oxolane (tetrahydrofurfuryl alcohol) are heated to 130°-140° C. 250 g of the dimeric ketene mentioned are then added in portions. The temperature of 130°-140° C. is then maintained for 2 h, after which the mixture is cooled to 70°-80° C. and 2000 ml acetonitrile added. After cooling, the deposit is filtered off under suction. Yield 273 g (62% of the theoretical).

The following intermediate products, for example, may be similarly obtained:

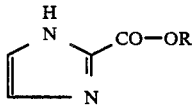

| R | Mp. |
|---|---|
| $—CH_2—CH_2—OCH_3$ | 106° C. |
| $—CH_2—CH_2—O—C_2H_5$ | 105° C. |
| 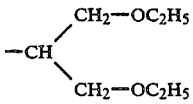 | 98° C. |
| 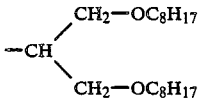 | (01) |
| $—CH_2—CH_2—O—CH_2—CH_2—O—C_4H_9$ | (01) |
| 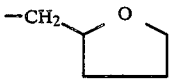 | 134° C. |
| 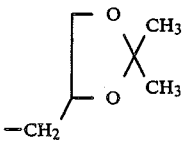 | 140° C. |
| 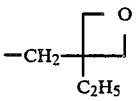 | (01) |
| 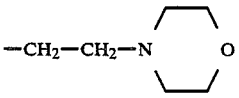 | 128° C. |
| 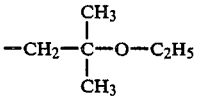 | 140° C. |
| 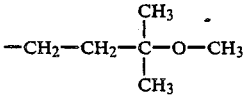 | 99° C. |

Preparation of coupler Y-3:

171 g 2-chloro-5-[ω-(2,4-di-tert.-amylphenoxy)-butyramido]-pivaloyl acetanilide were chlorinated with 24.5 g sulfuryl chloride at room temperature in 500 ml methylene chloride. The methylene chloride is then removed by evaporation and the residue dissolved in 800 ml dimethylacetamide. 66 g of the imidazole derivative obtained as described above are then added, followed by the dropwise addition at 25° to 30° C. of 80 ml tetramethyl guanidine. After stirring for 1–2 h, the reaction mixture is poured onto ice/water/hydrochloric acid. The deposit is filtered off under suction, washed and dried. The product is then recrystallized from methanol. Mp: 96°–98° C. Yield: 156 g (68% of the theoretical).

In the preparation of the photosensitive color photographic recording material, the 2-equivalent yellow couplers according to the invention may be incorporated in a known manner, optionally together with other couplers, in the casting solution of the silver halide emulsion layers or other colloid layers. Since they are distinguished by outstanding solubility in oil, the 2-equivalent yellow couplers according to the invention are preferably added to a hydrophilic colloid solution from a solution in a suitable coupler solvent (oil former), optionally in the presence of a wetting agent or dispersant. Besides the binder, the hydrophilic casting solution may of course contain other standard additives. The solution of th coupler does not have to be directly dispersed in the casting solution for the silver halide emulsion layer or in any other water-permeable layer. Instead, it may even be initially dispersed with advantage in an aqueous non-photosensitive solution of a hydrophilic colloid and the resulting mixture subsequently mixed before application, optionally after removal of the low-boiling organic solvent used, with the casting solution for the photosensitive silver halide emulsion layer or any other water-permeable layer.

Suitable photosensitive silver halide emulsions are emulsions of silver chloride, silver bromide or mixtures thereof, optionally with a small content of silver iodide of up to 10 mol-%, in one of the hydrophilic binders normally used. According to the invention, rapidly developable silver halide emulsions, for examples silver halide emulsions having a high content (for example more than 80 mol-%) of silver chloride, are particularly preferred. Gelatin is preferably used as binder for the photographic layers although it may be completely or partly replaced by other natural or synthetic binders.

The emulsions may be chemically and/or spectrally sensitized in the usual way and the emulsion layers and also other non-photosensitive layers may be hardened in the usual way with known hardeners. Hardening with so-called carboxyl-group-activating hardeners, for example carbamoyl pyridinium salts, is particularly advantageous.

The 2-equivalent yellow couplers according to the invention are normally added to a blue-sensitive silver halide emulsion layer. In addition, the color photographic recording material generally contains at least one green-sensitive and at least one red-sensitive silver halide emulsion layer.

In preferred embodiments, at least one non-diffusing color coupler for producing the cyan component dye image, generally a coupler of the phenol or α-naphthol type, is associated with red-sensitive silver halide emulsion layers. Advantageous cyan couplers are described, for example, in EP-Pat. No.-A-0 028 099, EP-Pat. No.-A-0 067 689, EP-Pat. No.-A-0 175 573 and EP-Pat. No.-A-0 184 057. At least one non-diffusing color coupler for producing the magenta component dye image is associated with green-sensitive silver halide emulsion layers, color couplers of the 5-pyrazolone, indazolone or pyrazoloazole type normally being used. Color couplers of this type are known in large numbers and are described in a number of patent specifications. Reference is made here by way of example to the articles entitled "Farbkuppler (Color Couplers)" by W. PELZ in "Mitteilungen aus den Forschungslaboratorien der Afga, Leverkusen/München", Vol. III, page 111 (1961) and by K. VENKATARAMAN in "The Chemistry of Synthetic of Synthetic Dyes", Vol. 4, 341 to 387, Academic Press (1971).

The color couplers may be both standard 4-equivalent couplers and also 2-equivalent couplers where a smaller quantity of silver halide is required for dye production. It is known that 2-equivalent couplers are derived from 4-equivalent couplers in that they contain in the coupling position a substituent which is eliminated during the coupling reaction. 2-equivalent couplers include both those which are substantially colorless and also those which have a strong color of their own which disappears or is replaced by the color of the image dye produced during the color coupling reaction. Couplers of the latter type may also be additionally present in the photosensitive silver halide emulsion layers where they serve as mask couplers for compensating the unwanted secondary densities of the image dyes. However, 2-equivalent couplers also include the known white couplers, although they do not produce a dye on reaction with color developer oxidation products. 2-equivalent couplers also include the known DIR couplers which are preferably used in accordance with the invention, i.e. couplers which, in the coupling position, contain a releasable group which is released as a diffusing development inhibitor on reaction with color developer oxidation products. Other photographically active compounds, for example development accelerators or fogging agents, may also be released from couplers such as these during the development process.

In addition to the non-diffusing color couplers, it is also occasionally possible to use couplable compounds of limited diffusibility, for example color compounds which are capable of diffusing over a limited distance, for example up to about 1 μm, in the layers in which they are situated before or during processing. The dye formed from a color coupler may also show limited diffusibility.

In addition to the constituents mentioned, the color photographic recording material according to the invention may contain other additives, for example antioxidants, dye stabilizers and agents for influencing the mechanical and electrostatic properties. In order to reduce or avoid the adverse effect of UV light on the dye images produced with the color photographic recording material according to the invention, it is of advantage to use UV-absorbing compounds in one or more of the layers present in the recording material, preferably in one of the upper layers. Suitable UV absorbers are described, for example, in US-Pat. No.-A-3,253,921, in DE-Pat. No.-C-20 36 719 and in EP-Pat. No.-A-0 057 160.

The usual layer supports (see Research Disclosure no. 17643, Chapter XVII) may be used for the materials according to the invention.

Suitable protective colloids or binders for the layers of the recording material are any of the usual hydrophilic film-forming agents, for example proteins, particularly gelatin. Casting aids and plasticizers may be used, cf. the compounds mentioned in Research Disclosure no. 17643, Chapters IX, XI and XII.

The layers of the photographic material may be hardened in the usual way, for example with hardeners of the epoxide type, the heterocyclic ethyleneimine type and the acryloyl type. The layers may also be hardened by the method according to DE-Pat. No.-A-22 18 009 to obtain color photographic materials which are suitable for high-temperature processing. The photographic layers may also be hardened with hardeners of the diazine, triazine or 1,2-dihydroquinoline series or with hardeners of the vinylsulfone type. Other suitable hardeners are known from DE-Pat. No.-A-24 39 551, from DE-Pat. No.-A-22 25 230, from DE-Pat. No.-A-23 17 672 and from the above-cited Research Disclosure no. 17643, Chapter XI.

Other suitable additives are mentioned in Research Disclosure no. 17643 and in "Product Licensing Index", December 1971, pages 107–110.

To produce color photographic images, the color photographic recording material according to the invention is developed with a color developer compound. The color developer compound may be any developer compound which is capable of reacting with color couplers in the form of its oxidation product to form azomethine dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methylsulfonamidoethyl)-3-methyl-p-phenylenediamine, 1-(N-ethyl-N-hydroxyethyl-3-methyl-p-phenylenediamine and 1-(N-ethyl-N-methoxyethyl)-3-methyl-p-phenylenediamine.

Other suitable color developers are described, for example, in J. Amer. Chem. Soc. 73, 3100 (1951) and in G. Haist, Modern Photographic Processing, 1979, John Wiley and Sons, New York, pages 545 et seq.

The recording material according to the invention is eminently suitable for processing in an abbreviated processing method, for example in a processing method of which the development step lasts less than 3 minutes and preferably less than 1 minute at temperatures of 30° to 80° C. Favorable results are also obtained where developer baths free from benzyl alcohol are used for development.

After color development, the material is bleached and fixed in the usual way. Bleaching and fixing may be carried out separately from or even together with one another. Suitable bleaches are any of the usual compounds, for example $Fe^{3+}$ salts and $Fe^{3+}$ complex salts, such as ferricyanides, dichromates, water-soluble cobalt complexes, etc. Particular preference is attributed to iron(III) complexes of aminopolycarboxylic acids, more especially for example ethylenediamine tetraacetic acid, N-hydroxyethyl ethylenediamine triacetic acid, alkyliminodicarboxylic acids, and of corresponding phosphonic acids. Persulfates are also suitable bleaches.

EXAMPLE 1

Color photographic recording materials were prepared and processed as follows:

(a) Preparation of the color coupler dispersates 8 mmol color coupler as shown in Table 1 are dissolved in the same quantity by weight of dibutylphthalate and three times the quantity by weight of ethyl acetate in the presence of 0.15 g sulfosuccinic acid dioctyl ester at a temperature of 50° to 75° C. The resulting solution is then stirred into 150 g of a 7.5% by weight aqueous gelatin solution heated to a temperature of around 40° C.

(b) Preparation of the color photographic recording materials to be tested

The dispersate prepared as described in (a) is mixed with a silver halide emulsion containing 8.2 g silver in the form of silver bromide iodide, (4 mol-% iodide), 9.2 g gelatin and 0.04 g sodium dodecyl benzenesulfonate. The total volume is adjusted with water to 350 ml. The casting solution thus prepared is cast onto a layer support of cellulose triacetate.

(c) Hardening and drying

A hardening layer of 400 mg gelatin and 400 mg instant hardener [CAS Reg. no. 65 411-60-1] is cast onto the layer thus cast, followed by drying at 50° to 60° C.

(d) Processing and evaluation

Development 1

(a) Color developer—3.5 mins—33° C.
- 15 ml benzylalcohol
- 15 ml ethylene glycol
- 3 g hydroxylamine sulfate
- 4.5 g 3-methyl-4-amino-N-ethyl-N-(β-methanesulfonamidoethyl)-aniline sulfate
- 32 g $K_2CO_3$
- 2 g $K_2SO_3$
- 0.6 g KBr
- 1 g disodium salt of 1-hydroxyethane-1,1-diphosphonic acid make up with water to 1000 ml; pH 10.2

(b) Bleaching/fixing bath—1.5 mins
- 35 ml ammonia solution (28%)
- 30 g EDTA
- 15 g $Na_2SO_3$
- 100 g ammonium thiosulfate
- 60 g sodium-(EDTA)-iron(III) complex make up with water to 1000 ml; pH 7.

(c) Rinsing—3 mins

Development 2

(a) Color developer—45 s—35° C.

| | |
|---|---|
| Triethanolamine | 9.0 g |
| N,N—diethyl hydroxylamine | 6.0 g |
| Diethylene glycol | 0.05 g |
| 3-Methyl—4-amino-N—ethyl-N—methanesulfonamidoethyl aniline sulfate | 6.0 g |
| Potassium sulfite | 0.2 g |
| Triethylene glycol | 0.05 g |
| Potassium carbonate | 22 g |
| Potassium hydroxide | 0.4 g |
| Ethylenediamine tetraacetic acid, disodium salt | 2.2 g |
| make up with water to 1000 ml; pH 9.2. | |

(b) Bleaching/fixing bath—45 s—33° C.

| | |
|---|---|
| Ammonium thiosulfate | 75 g |
| Sodium hydrogen sulfite | 13.5 g |
| Ammonium acetate | 2.0 g |
| Ethylenediamine tetraacetic acid (iron-ammonium salt) | 57 g |
| Ammonia, 25% | 9.5 g |
| Acetic acid | |

c. Rinsing—2 mins.—33° C.

The following comparison couplers were used:

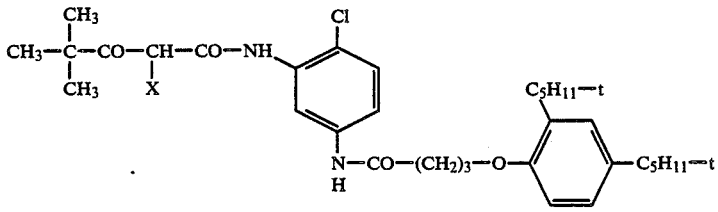

C-1

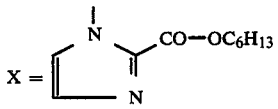

C-2

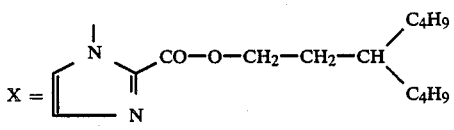

C-5

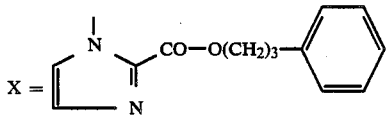

C-6

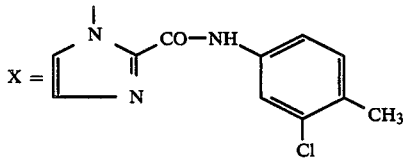

C-6

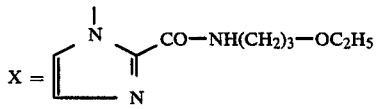

C-3

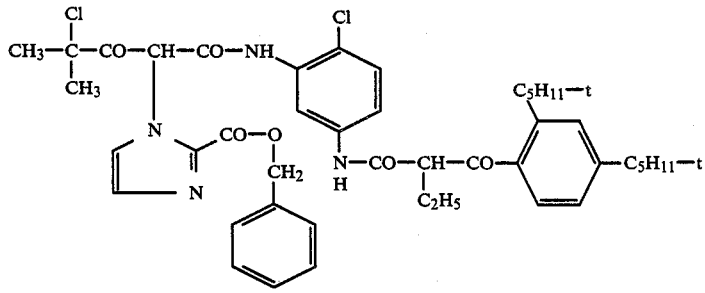

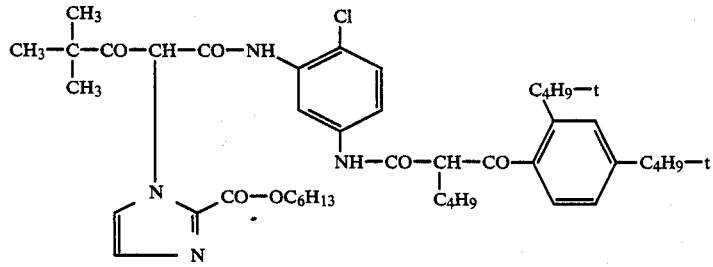

The results obtained after development 1 and development 2 are shown in Table 1 for each of the couplers compared with one another, comprising the gradation ($\gamma_1$, $\gamma_2$) as the gradient of the gradation curve in the vicinity of the linear trend, i.e. at density $\geqq 0.7$, and the color yield ($CY_1$, $CY_2$) as the quotient of $D_{max}$ and the silver applied. In addition, the quotients $\gamma_1/\gamma_2$ and $CY_1/CY_2$ are shown in the last two columns of Table 1.

TABLE 1

| Coupler | Development 1 | | Development 2 | | | |
|---|---|---|---|---|---|---|
| | $\gamma_1$ | $CY_1$ | $\gamma_2$ | $CY_2$ | $\gamma_1/\gamma_2$ | $CY_1/CY_2$ |
| C-1 | 1.42 | 1.54 | 0.65 | 1.03 | 2.18 | 1.50 |
| C-2 | 1.18 | 1.70 | 0.62 | 0.85 | 1.90 | 2.00 |
| C-3 | 1.14 | 1.12 | 0.65 | 0.90 | 1.75 | 1.24 |
| C-4 | 0.98 | 0.86 | 0.61 | 0.76 | 1.61 | 1.13 |
| C-5 | 1.16 | 1.23 | 0.63 | 1.09 | 1.84 | 1.13 |
| C-6 | 1.28 | 1.48 | 0.36 | 0.51 | 3.56 | 2.90 |
| C-7 | 1.16 | 1.34 | 0.24 | 0.43 | 4.83 | 3.12 |
| Y-1 | 1.58 | 1.57 | 0.72 | 1.43 | 2.19 | 1.10 |
| Y-2 | 1.52 | 1.51 | 0.70 | 1.47 | 2.17 | 1.03 |
| Y-3 | 1.52 | 1.48 | 0.77 | 1.39 | 1.97 | 1.06 |
| Y-5 | 1.35 | 1.46 | 0.92 | 1.36 | 1.46 | 1.07 |
| Y-7 | 1.46 | 1.55 | 0.68 | 1.42 | 2.14 | 1.09 |
| Y-8 | 1.46 | 1.46 | 0.81 | 1.41 | 1.80 | 1.04 |
| Y-10 | 1.48 | 1.55 | 0.76 | 1.50 | 1.95 | 1.03 |
| Y-11 | 1.48 | 1.51 | 0.78 | 1.38 | 1.90 | 1.09 |
| Y-12 | 1.22 | 1.32 | 0.78 | 1.31 | 1.56 | 1.01 |
| Y-14 | 1.47 | 1.61 | 0.75 | 1.52 | 1.96 | 1.06 |
| Y-19 | 1.33 | 1.44 | 0.85 | 1.45 | 1.56 | 0.99 |
| Y-20 | 1.42 | 1.54 | 0.67 | 1.48 | 2.12 | 1.04 |

It can be seen from Table 1 that a number of couplers, including for example the comparison couplers C-1, C-2, C-6 and C-7, show excellent coupling behavior during processing in development 1, as documented by useful gradation and a high color yield. During processing in development 2, the comparison couplers in particular show a distinct reduction in their sensitometric values. As also documented by the quotients shown in the last two columns.

The color yield quotient in the last column is of particular significance in this regard, representing an absolute measure of the reactivity of the color coupler. Small figures are indicative of the fact that the reactivity of the coupler is so high that a very coupler conversion is obtained, even in distinctly slower developers, such as for example developer 2 free from benzylalcohol.

Couplers according to the invention are distinguished by mass numbers of $\leqq 1.10$.

This mass number is almost reached even by comparison couplers, for example C-4 and C-5. However, these two compounds are photographically unuseable because the absolute values $\gamma_2$ and $CY_2$ are too low for the couplers to be used.

EXAMPLE 2

10 g coupler are dissolved in 10 g dibutyl phthalate and 20 g ethyl acetate and the resulting solution subsequently incorporated by emulsification in the usual way in 100 g of a 10% gelatin solution containing 0.5% dodecyl benzenesulfonate. The ethyl acetate is then evaporated off.

The emulsate obtained is added to a blue-sensitized silver chloride emulsion so that the mixture then contains 1.3 g coupler per 1 g $AgNO_3$.

After addition of a wetting agent, the casting solution is then applied to a polyethylene-lined paper (silver applied = 0.55 g $AgNO_3/m^2$). A protective gelatin layer containing a carbamoyl pyridinium salt as hardener is then applied (0.8 g gelatin/$m^2$).

After drying of the web, a $\sqrt[3]{2}$ -step wedge is exposed onto the paper behind a blue filter, followed by processing in a rapid development line in accordance with development 2 (Example 1).

The yellow step wedge obtained is then evaluated, the sensitometric data shown in Table 2 for threshold and shoulder gradation G1 and G2 and also the maximal density $D_{max}$ being obtained for the couplers used:

TABLE 2

| Coupler | $G_1$ | $G_2$ | $D_{max}$ |
|---|---|---|---|
| Y-2 | 1.73 | 2.92 | 2.38 |
| Y-1 | 1.76 | 3.05 | 2.44 |
| Y-19 | 1.75 | 3.15 | 2.47 |
| Y-3 | 1.72 | 3.08 | 3.42 |
| Y-5 | 1.65 | 3.20 | 2.51 |
| Y-8 | 1.72 | 2.85 | 2.53 |
| Y-11 | 1.77 | 3.05 | 2.45 |
| C-1 | 1.39 | 1.49 | 2.46 |

A wavy and flat gradation curve is obtained with the comparison coupler C-1 while the couplers according to the invention give a normal and sufficiently steep gradation By way of illustration, the gradation curves of comparison coupler C-1 (curve 1) and coupler Y-5 according to the invention (curve 2) are shown in FIG. 1.

We claim:

1. A color photographic recording material comprising at least one photosensitive silver halide emulsion layer and, associated therewith, a 2-equivalent yellow coupler to the coupling position of which an imidazole-2-carboxylic acid ester group is attached by a ring nitrogen atom, characterized in that the 2-equivalent yellow coupler corresponds to the following formula

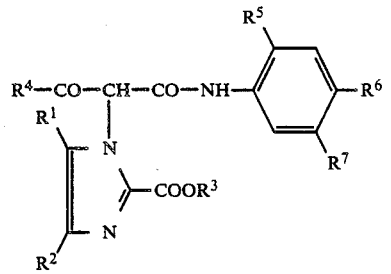

in which $R^1$, $R^2$ (same or different) represent hydrogen, alkyl or halogen;

$R^3$ represents alkoxyalkyl or an alkyl radical substituted by a heterocyclic group containing at least one oxygen atom;

$R^4$ represents alkyl or aryl;

$R^5$ represents halogen or alkoxy;

$R^6$ represents hydrogen, alkoxy, amino, acylamino or carbamoyl;

$R^7$ represents alkoxy, acylamino, carbalkoxy, carbamoyl or sulfamoyl.

* * * * *